US007146674B2

(12) United States Patent
Velez, Jr. et al.

(10) Patent No.: US 7,146,674 B2
(45) Date of Patent: Dec. 12, 2006

(54) ROTARY PROBE FOR CLEANING AN INTERNAL CAVITY

(75) Inventors: Ramon M. Velez, Jr., Windsor, CT (US); Peter J. Draghi, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 164 days.

(21) Appl. No.: 10/801,870

(22) Filed: Mar. 16, 2004

(65) Prior Publication Data

US 2005/0204489 A1 Sep. 22, 2005

(51) Int. Cl.
*B08B 9/027* (2006.01)

(52) U.S. Cl. ..... 15/104.05; 15/104.095

(58) Field of Classification Search ..... 15/104.05, 15/104.33, 104.095
See application file for complete search history.

(56) References Cited

U.S. PATENT DOCUMENTS 267,306 A * 11/1882 Gall ..... 137/242
507,435 A * 10/1893 Helfensteller, Jr. ..... 15/104.33
984,473 A * 2/1911 Cornelius ..... 15/104.33
1,851,766 A * 3/1932 Hotchkiss, Jr. ..... 15/104.33
5,230,116 A * 7/1993 Rodriguez ..... 15/104.33
5,769,960 A * 6/1998 Nirmel ..... 134/22.11
6,094,765 A * 8/2000 Askenase ..... 15/104.05
6,564,823 B1 * 5/2003 Mankins ..... 137/318
6,920,663 B1 * 7/2005 Petit ..... 15/104.33

FOREIGN PATENT DOCUMENTS

JP 5-329453 * 12/1993

* cited by examiner

*Primary Examiner*—Randall Chin
(74) *Attorney, Agent, or Firm*—Wall Marjama & Bilinski LLP

(57) ABSTRACT

Foreign material is dislodged from a hard to reach region of an object by passing a rigid elongated tubular guide in close proximity to the hard to reach region. The upper tip of the guide is bent so that it can be directed at the hard to reach region and a wire is passed through the guide into the hard to reach region. The lower portion of the wire that extends outwardly from the bottom of the guide and the wire is rotated at a speed sufficient to dislodge unwanted foreign material from the hard to reach region.

7 Claims, 2 Drawing Sheets

ROTARY PROBE FOR CLEANING AN INTERNAL CAVITY

RELATED APPLICATION

This invention relates to U.S. patent application Ser. No. 10/271,681 entitled Apparatus and Method for Cleaning Airfoil Internal Cavity, filed on Oct. 15, 2002, now U.S. Pat. No. 6,805,140, and assigned to the assignee of the present invention and which is incorporated herein by reference.

FIELD OF THE INVENTION

This invention relates to efficiently dislodging foreign material from an internal cavity of an object such as a turbine blade and, in particular, to dislodging foreign material from hereto for relatively inaccessible regions inside an airfoil cavity.

BACKGROUND OF THE INVENTION

The turbine blades found in most, if not all, jet engines in use today are cooled by passing a coolant through the interior of the blade. The coolant cavity typically has a torturous path of travel and may include one or more 180° turns. During use of the engine or repairs performed on the parts, foreign matter may enter the cavities of the engine blades and become adhered to the walls of the cavities, particularly in the hard to reach bend regions. In an effort to dislodge foreign matter from the walls of the blade cavities, metal wires of varying diameters are passed into the blade cavities through openings in the blade roots and the wire is turned at a speed that is sufficient high enough to dislodge any foreign material that it comes in contact with. This type of device works well in easy to reach locations. However, the wires cannot readily contact foreign matter that has lodged in the hard to reach areas. In addition, the flexible wire has a tendency to hang up on the walls of the cooling cavity making maneuvering of the probe rather difficult.

SUMMARY OF THE INVENTION

It is therefore an object of the present invention to more thoroughly dislodge foreign material from an internal cavity of an object such as the cooling cavity of a turbine blade.

It is a further object of the present invention to improve means for dislodging foreign matter from the internal cavity of an object.

A still further object of the present invention is to provide a probe for dislodging foreign material that is located in hard to reach internal areas of an object.

These and further objects of the present invention are attained by a probe having a wire that passes through a tubular guide so that the wire may be rotated within the guide. The distal end of the guide is bent at an angle whereby the guide can be inserted into an internal passage of an object and the wire directed into a hard to reach region to dislodge unwanted foreign material from the hard to reach region.

BRIEF DESCRIPTION OF THE DRAWINGS

For a better understanding of these and other objects of the invention, reference will be made to the following detailed description of the invention which is to be read in connection with the accompanying drawing, wherein.

DETAILED DESCRIPTION OF THE INVENTION

Figure 1:
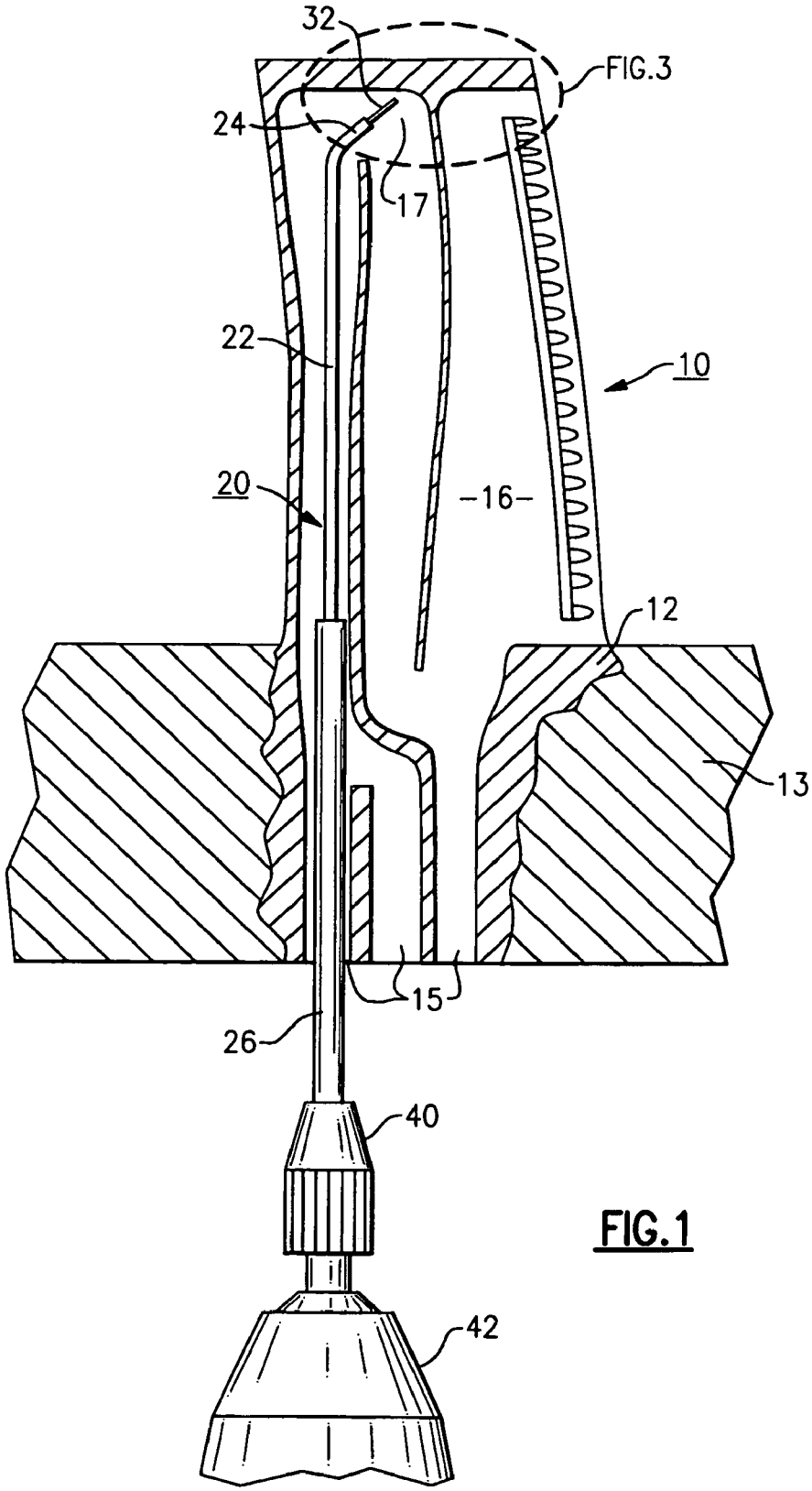
FIG. 1 is illustrates a turbine blade in cross section that is mounted within a holding fixture and an elongated probe embodying the teachings of the invention is shown passing upwardly into a blade cavity through an opening in the blade root.

Turning now to the drawings there is illustrated in FIG. 1 a turbine blade, generally referenced 10, that has been removed from a jet engine. Although this disclosure will be made with specific reference to a jet engine turbine blade, it should be understood that the present invention can be utilized in association with any object containing an internal cavity that may entrap foreign material. The root 12 of the blade is mounted within a holding fixture 13 arranged to securely hold the blade in a desired position while at the same time permitting free access to openings 15 leading to an internal cooling cavity 16 through the root of the blade.

The cooling cavity, as is typical in most turbine blades, follows a torturous path of travel having difficulty to reach regions such as the bend area 17 located in the top section of the blade. Normally, an unsupported straight length of flexible wire that is typically used to dislodge foreign matter 18 from the cavity will not be able to effectively penetrate this bend area.

Figure 2:
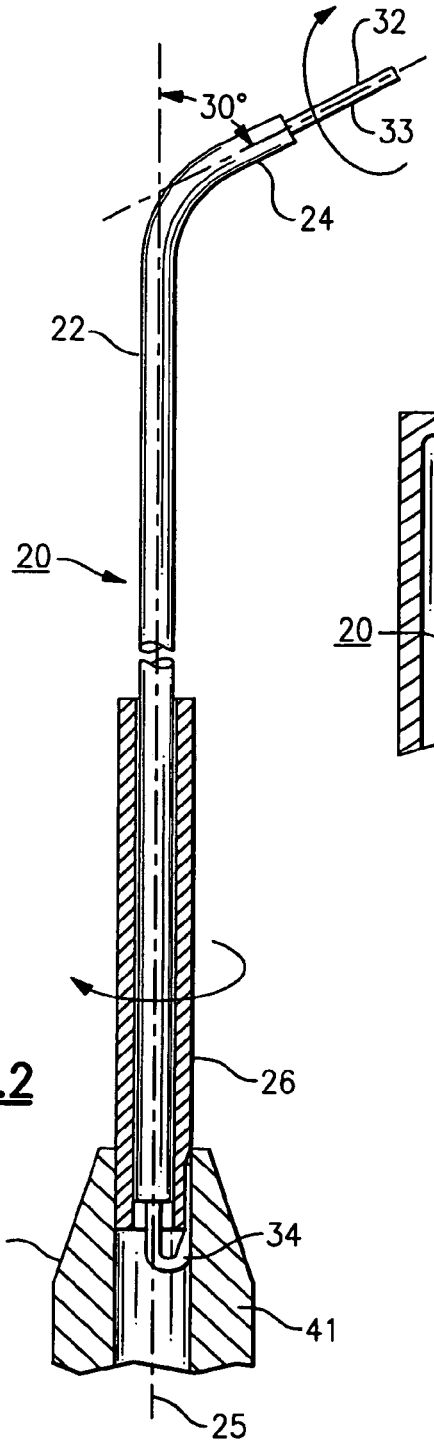
FIG. 2 is an enlarged view in section of the upper part of the blade cavity showing the probe positioned adjacent a difficult to reach bend region.
Figure 3:
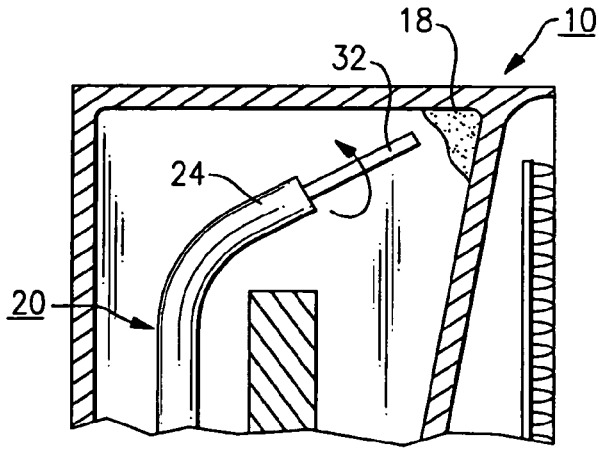
FIG. 3 is an enlarge side elevation in partial section further illustrating the probe of the present invention in greater detail.

A probe or dislodging tool, generally referenced 20, that embodies the teachings of the present invention is illustrated in greater detail in FIGS. 2 and 3. The probe includes an elongated tubular wire guide 22 that is capable of being inserted upwardly through a root opening in the blade. Preferably, the guide is fabricated of a rigid material such as a length of stainless steel tubing. The guide is of sufficient length such that the guide can extend the full length of the entrance passage to a point adjacent to the hard to reach region 17 typically located at the top of the passage. The tip 24 of the guide is bent at an angle with regard to the axis 25 of guide so that the opening at the distal end of the guide can be directed at the hard to reach region. The length of the bend is relatively short so that the guide is able to move freely through cooling passage without snagging upon the passage wall. It has been found that an angle of about 30° at the tip of the guide works well in most blade applications. The angle may be adjusted, however, depending on the specific application.

The lower section of the guide can be housed within a tubular sleeve 26 so that the sleeve can rotate about the axis of the guide. A close running fit may be provided between the outer wall of the guide and the inner wall of the sleeve so that the sleeve can turn freely about the axis of the guide without wobbling. It has been found that good results are realized when the sleeve extends upwardly from the bottom of the guide to about halfway up the guide. A flexible metal wire 32 is passed upwardly through the center opening in the guide so that both the top end section 33 and the bottom end section 34 of the wire extend outwardly from the respective distal and proximal ends of the guide. Here again a close running fit is provided between the inner wall of the guide and the outer surface of the wire so that the wire can turn freely about the axis of the guide as well as being moved axially within the guide.

The bottom section 34 of the wire can be secured to the outer wall of the sleeve. As shown in FIG. 3, the wire is turned around the bottom of the sleeve. Preferably, the wire is held against the outer surface of the sleeve by means of an adjustable chuck 40 that is mounted upon a driver 42. The motor in practice may be battery driven or connected to a readily available 120 volt outlet. The jaws 41 of the chuck are arranged to close over both the sleeve and the wire. Sufficient closing force is applied by the jaws to crimp the wire securely against the outer surface of the sleeve whereby both the wire and the sleeve can be rotated together at a desired speed. As can be seen, the guide is not turned as the chuck rotates and accordingly the distal end of the guide can be directed into a hard to reach region.

Although the wire is secured to the sleeve of by the jaw of an adjustable chuck in this embodiment of the invention, it should be clear that any suitable means for securing the wire to the sleeve can be employed without departing from the teachings of the present invention. Such techniques may involve welding or brazing the wire to the sleeve or simply wrapping the wire around the sleeve.

In the practice of the present invention, the bent tip of the wire guide is brought adjacent to the hard to reach region and is pointed directly at the region. Sufficient wire is extended outwardly from the tip so that the wire will be able to contact any foreign material in this region. The cojoined wire and sleeve are then rotated at a relatively high speed to dislodge this unwanted material from the region and the dislodged material then be easily flushed from the cooling cavity. Positioning of the probe within the cooling cavity can be accomplished using well known x-ray imaging techniques.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. Apparatus for dislodging foreign material from an interior cavity of an object that includes:

a tubular guide having a distal end and a proximal end such that the distal end of the guide can be inserted into an interior cavity of said object;

a tubular sleeve mounted over at least a lower portion of said guide so that said sleeve can rotate about an axis of said guide;

a wire passing through said guide so that an upper portion of the wire extends outwardly from the distal end of the guide and a lower portion of the wire extends outwardly from the proximal end of the guide;

wherein the extended lower portion of the wire is secured to said sleeve whereby the wire and the sleeve can rotate together about the axis of the guide; and wherein said distal end of the guide is bent at an angle with relation to the axis of said guide.

2. The apparatus of claim 1 that further includes drive means for rotating said sleeve and said wire together.

3. The apparatus of claim 2 wherein said lower portion of the wire is secured to said sleeve by an adjustable chuck that is connected to said drive means, said chuck having jaws that are arranged to close over the sleeve and the wire to crimp the wire into engaging contact against the outside of said sleeve whereby the sleeve and the wire can be rotated together by said drive means.

4. The apparatus of claim 3 wherein said drive means is an electric motor.

5. The apparatus of claim 1 wherein said wire forms a close running fit with the interior wall of said guide.

6. The apparatus of claim 1 wherein said distal end of the guide forms an angle of about 30° with said axis of said guide.

7. The apparatus of claim 6 wherein the axial length of said sleeve is about half that of said guide.

* * * * *